US010590623B2

(12) United States Patent
Karasawa et al.

(10) Patent No.: US 10,590,623 B2
(45) Date of Patent: Mar. 17, 2020

(54) CONSTRUCTION MACHINE

(71) Applicant: Hitachi Construction Machinery Co., Ltd., Taito-ku, Tokyo (JP)

(72) Inventors: Hideo Karasawa, Tsukuba (JP); Katsuaki Kodaka, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/328,972

(22) PCT Filed: Mar. 20, 2018

(86) PCT No.: PCT/JP2018/011159
§ 371 (c)(1),
(2) Date: Feb. 27, 2019

(87) PCT Pub. No.: WO2018/174084
PCT Pub. Date: Sep. 27, 2018

(65) Prior Publication Data

US 2019/0194904 A1 Jun. 27, 2019

(30) Foreign Application Priority Data

Mar. 21, 2017 (JP) ..... 2017-054601

(51) Int. Cl.
*E02F 9/22* (2006.01)
*E02F 3/43* (2006.01)
(Continued)

(52) U.S. Cl.
CPC ..... *E02F 3/435* (2013.01); *E02F 3/32* (2013.01); *E02F 3/425* (2013.01); *E02F 9/0883* (2013.01);
(Continued)

(58) Field of Classification Search
CPC ..... F15B 11/10; F15B 21/02; E02F 9/2235; E02F 9/2282; E02F 9/2285; E02F 9/2296
See application file for complete search history.

(56) References Cited

U.S. PATENT DOCUMENTS 7,562,615 B2 * 7/2009 Abe ..... E02F 9/2235 91/436
8,336,443 B2 * 12/2012 Abe ..... E02F 9/2235 91/436
(Continued)

FOREIGN PATENT DOCUMENTS

JP 2005-220544 A 8/2005
JP 2005-221026 A 8/2005
(Continued)

OTHER PUBLICATIONS

International Search Report (PCT/ISA/210) issued in PCT Application No. PCT/JP2018/011159 dated May 15, 2018 with English translation (four pages).
(Continued)

*Primary Examiner* — Michael Leslie
(74) *Attorney, Agent, or Firm* — Crowell & Moring LLP

(57) ABSTRACT

A controller according to the present invention has: a storage section that stores a first relationship between manipulated variables of an operating lever preset for each vehicle-body weight and target delivery pressures of a hydraulic pump; a target delivery pressure computation section that applies the vehicle-body weight inputted through an input device and the manipulated variable of the operating lever corresponding to a pilot pressure detected by pilot pressure sensors, to a first relationship stored in the storage section in order to calculate a target delivery pressure of the hydraulic pump; and a feedback control section that performs feedback control on the center bypass selector valve such that the delivery pressure of the hydraulic pump detected by the
(Continued)

delivery pressure sensor agrees with the target delivery pressure of the hydraulic pump calculated by the target delivery pressure computation section.

4 Claims, 6 Drawing Sheets

(51) Int. Cl.

| | |
|---|---|
| ***E02F 9/08*** | (2006.01) |
| ***E02F 3/42*** | (2006.01) |
| ***E02F 9/20*** | (2006.01) |
| ***F15B 11/10*** | (2006.01) |
| ***E02F 3/32*** | (2006.01) |

(52) U.S. Cl.

CPC ..... *E02F 9/2025* (2013.01); *E02F 9/2225* (2013.01); *E02F 9/2232* (2013.01); *E02F 9/2267* (2013.01); *E02F 9/2271* (2013.01); *E02F 9/2282* (2013.01); *E02F 9/2296* (2013.01); *F15B 11/10* (2013.01); *E02F 9/2285* (2013.01); *E02F 9/2292* (2013.01); *F15B 2211/20523* (2013.01); *F15B 2211/20546* (2013.01); *F15B 2211/25* (2013.01); *F15B 2211/35* (2013.01); *F15B 2211/6309* (2013.01); *F15B 2211/6652* (2013.01); *F15B 2211/7053* (2013.01)

(56) References Cited

U.S. PATENT DOCUMENTS

| | | | | |
|---|---|---|---|---|
| 8,650,778 | B2 * | 2/2014 | Okano ..... | E02F 9/2296 60/421 |
| 9,790,966 | B2 * | 10/2017 | Akiyama ..... | E02F 9/2282 |
| 2014/0283510 | A1 | 9/2014 | Akiyama et al. | |

FOREIGN PATENT DOCUMENTS

| | | | |
|---|---|---|---|
| JP | 2009-281062 | A | 12/2009 |
| JP | 2010-230039 | A | 10/2010 |
| JP | 2012-52583 | A | 3/2012 |
| JP | 2013-170696 | A | 9/2013 |
| WO | WO 2016/169939 | A1 | 10/2016 |

OTHER PUBLICATIONS

Japanese-language Written Opinion (PCT/ISA/237) issued in PCT Application No. PCT/JP2018/011159 dated May 15, 2018 (three pages).

* cited by examiner

CONSTRUCTION MACHINE

TECHNICAL FIELD

The present invention relates to construction machine, such as a hydraulic excavator and the like, which enables jack-up operation using a boom lowering motion of a boom.

BACKGROUND ART

Commonly, construction machine, such as a hydraulic excavator and the like, includes an engine as a prime mover, a hydraulic pump driven by the engine, and hydraulic actuators for a boom cylinder, bucket cylinder and/or the like which are operated by pressure oil discharged from the hydraulic pump. The hydraulic actuator is operated to actuate a front working device such as a boom, a bucket or the like mounted in the front of the vehicle body in order to perform required work such as excavation, dumping or the like.

In the construction machine having such a configuration, mud and the like adhering to a crawler are removed by stranding the machine on a bump on a road surface in the travel direction during the working or alternatively by causing the crawler of the undercarriage to be idle. To that purpose, the jack-up operation is performed to jack up the vehicle body by pressing the bucket against the ground with the boom lowering motion. Then, there is a need in the conventional art for hydraulic equipment that is capable of causing the boom to produce a great pressing force without loss of intended operability of the boom lowering motion.

Known as a conventional technique including hydraulic equipment of this type is a hydraulic drive system for construction machine which has: a control valve including an open-center type directional control valve to control a flow of pressure oil to be supplied from a hydraulic pump to a hydraulic actuator; and an operating device to operate switching of the directional control valve, in which the control valve has two directional control valves with different operational performances for each section of the hydraulic actuator and the hydraulic drive system is equipped with signal switching means for selecting one of the two directional control valves to which an operating signal from the operating device is directed (see, e.g., Patent Literature 1).

Also known as another conventional technique is a hydraulic circuit for a hydraulic working mechanism which includes: a directional control valve to control a flow of pressure oil flowing to a boom cylinder; and an operating device to perform switching operation for the directional control valve, as well as: a jack-up selector valve which is switched when a bottom pressure of a boom cylinder reaches a predetermined pressure; flow-path changing means for changing, to an open path or a closed path, a flow path of pressure oil to be supplied to a meter-in section of the directional control valve in step with the switching operation for the jack-up selector valve; and a slow return circuit including a throttle and a check valve to control the flow path of pressure oil to switch the jack-up selector valve (see e.g., Patent Literature 2).

CITATION LIST

Patent Literature

PATENT LITERATURE 1: JP-A No. 2005-220544
PATENT LITERATURE 2: JP-A No. 2005-221026

SUMMARY OF INVENTION

Technical Problem

In the above-described conventional technique disclosed in PTL 1, for the jack-up operation, one of the two directional control valves is selected, which has valve-opening area characteristics of fully closing a variable throttle in a center bypass oil passage in proximity of the full stroke position. Thereby, the center bypass oil passage is fully closed to provide a powerful boom lowering motion. However, if the operating device is minutely operated during the boom lowering motion to close the center bypass oil passage in a complete fashion, a sudden rise in delivery pressure of the hydraulic pump occurs to cause the pressure oil to gush. This may impair the operability for the jack-up operation and/or may have an influence on the flow rate control on the hydraulic pump. Because of this, there is apprehension that any disadvantage may arise, such as speed variations of hydraulic actuators in the combined operation of concurrently driving one or more hydraulic actuators.

Also, in the above-described conventional technique disclosed in PTL 2, when the bottom pressure of the boom cylinder falls below a predetermined pressure during the boom lowering motion, the pressure oil delivered by the hydraulic pump is supplied into a rod chamber of the boom cylinder through the directional control valve. In this state, the delivery pressure of the hydraulic pump gradually increases with respect to manipulated variable of the operating device. However, in the case of construction machines having a vehicle body with relatively heavy weight, such as a mid-sized, large sized hydraulic excavator and the like, an increased pressure in the jack-up operation is required for jacking up the vehicle body. This gives rise to a problem of withdrawing the amount of lifting the vehicle body (the amount of upward movement of the vehicle body) with respect to the manipulated variable of the operating device. Also, changing the types of work may involve replacement of the boom, the arm or an attachment at the distal end of the hydraulic excavator. In this case, the weight of the hydraulic excavator changes from the weight before shipment. In the event of increase in weight, such factory setting may cause a situation in which the lifting force required for jacking up cannot be produced.

The present invention has been achieved to address such realities in conventional art, and it is an object thereof to provide construction machine capable of achieving satisfactory operational performance in jack-up operation irrespective of a weight of a vehicle body.

Solution to Problem

To achieve the object, the present invention provides construction machine which includes: an engine; a hydraulic oil tank that stores hydraulic oil; a hydraulic pump that is driven by the engine and delivers the hydraulic oil in the hydraulic oil tank as pressure oil; a boom cylinder that is operated by the pressure oil delivered by the hydraulic pump; a directional control valve of an open-center type that controls a flow of the pressure oil; an operating device that performs switching operation of the directional control valve; and a boom that rotates in vertical directions through extension and contraction of the boom cylinder. The construction machine performs jack-up operation to lift a vehicle body up by use of a boom lowering motion of the boom. The construction machine includes: a body weight acquisition device that acquires a weight of the vehicle body; a manipulated variable detector that detects a manipulated variable of the operating device; a delivery pressure detector that detects a delivery pressure of the hydraulic pump; a center bypass selector valve that is installed midway through a center bypass duct and downstream of the directional control valve, the center bypass duct connecting the hydraulic pump to the hydraulic oil tank, the center bypass selector valve having valve-opening area characteristics capable of fully closing the center bypass duct; a center-bypass-selector-valve operating valve that performs switching operation of the center bypass selector valve; and a controller that controls operation of the center bypass selector valve on the basis of the weight of the vehicle body acquired by the body weight acquisition device, the manipulated variable of the operating device detected by the manipulated variable detector, and the delivery pressure of the hydraulic pump detected by the delivery pressure detector. The controller includes: a storage section that stores a first relationship between manipulated variables of the operating device for the boom lowering motion preset for each weight of the vehicle body and target delivery pressures of the hydraulic pump; a target delivery pressure computation section that applies the weight of the vehicle body acquired by the body weight acquisition device, and the manipulated variable of the operating device detected by the manipulated variable detector, to the first relationship stored in the storage section in order to calculate a target delivery pressure of the hydraulic pump; and a feedback control section that performs feedback control on the center bypass selector valve through the center-bypass-selector-valve operating valve such that the delivery pressure of the hydraulic pump detected by the delivery pressure detector agrees with the target delivery pressure of the hydraulic pump calculated by the target delivery pressure computation section.

Advantageous Effects of Invention

With the construction machine according to the present invention, satisfactory operational performance in jack-up operation can be achieved irrespective of a weight of a vehicle body. The above and other problems, configurations and advantageous effects will be more apparent from the following description of embodiments.

DESCRIPTION OF EMBODIMENT

Embodiments for achieving construction machine according to the present invention will now be described with reference to the accompanying drawings.

Figure 1:
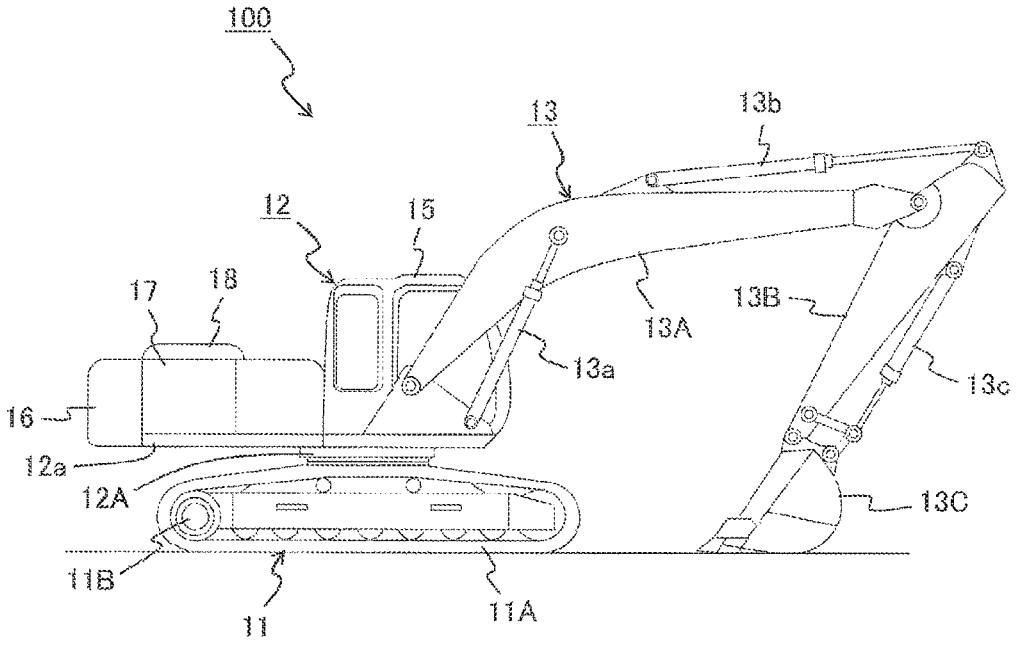
FIG. 1 is an overall view illustrating the configuration of a hydraulic excavator cited as an embodiment of the construction machine according to the present invention.
Figure 2:
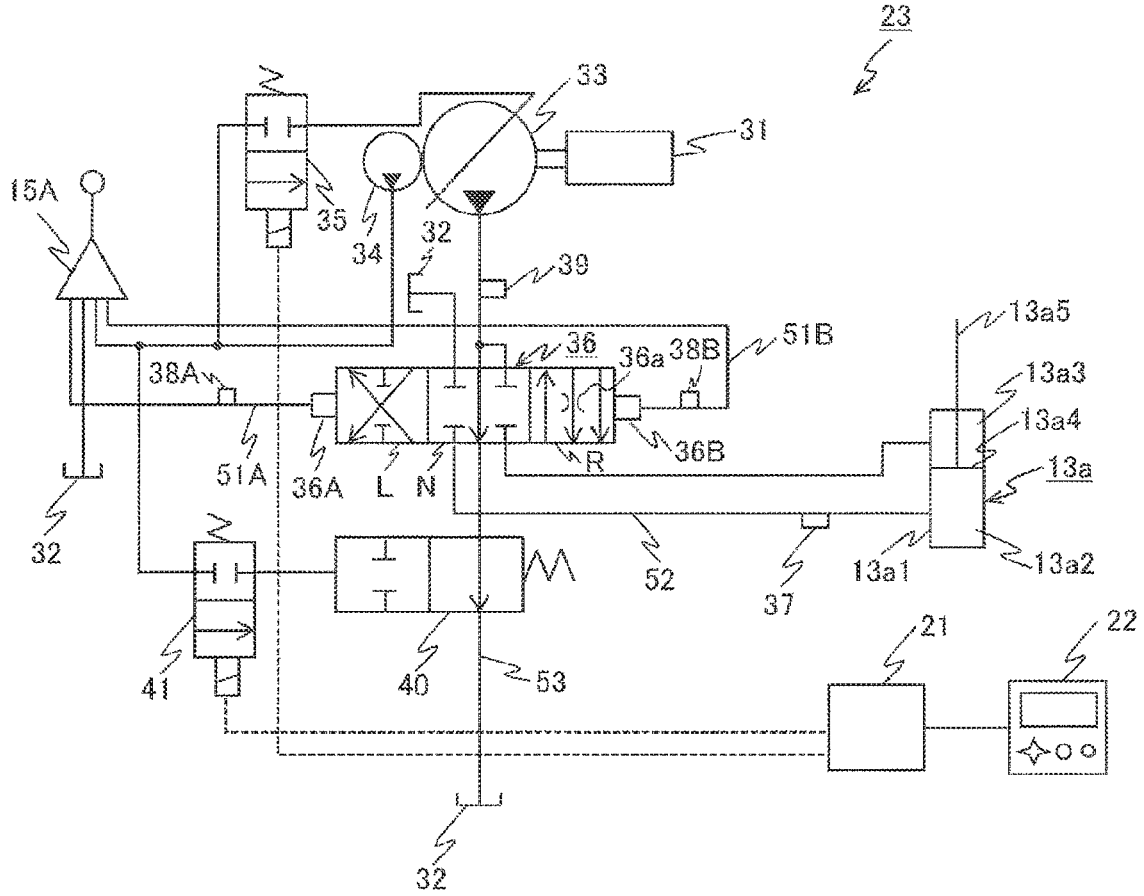
FIG. 2 is a hydraulic circuit diagram illustrating the internal configuration of an upperstructure shown in FIG. 1.

FIG. 1 is an overall view illustrating the configuration of a hydraulic excavator 100 cited as an embodiment of the construction machine according to the present invention. FIG. 2 is a hydraulic circuit diagram illustrating the internal configuration of an upperstructure 12 shown in FIG. 1.

An embodiment of the construction machine according to the present invention includes, for example, a hydraulic excavator 100 illustrated in FIG. 1. The hydraulic excavator 100 includes a undercarriage 11, an upperstructure 12 that is swingably mounted on the top side of the undercarriage 11 via a swing device 12A, and a front working device 13 that is attached to the front of the upperstructure 12 to rotate in the vertical directions.

The undercarriage 11 has a pair of left and right crawlers 11A and a pair of left and right travel motors 11B that drive the pair of left and right crawlers 11A. Each of the travel motors 11B is placed at one end of each crawler 11A in a front-rear direction. The swing device 12A has a swing motor (not shown) placed therein. The pair of travel motors 11B and the swing motor are each composed of, for example, a hydraulic motor powered by hydraulic pressure.

The upperstructure 12 has: a cab 15 that is placed in the front of the vehicle body for an operator to board; a counterweight 16 that is placed at the rear of the vehicle body for keeping the balance of the vehicle body; a machine room 17 that is placed between the cab 15 and the counterweight 16 and houses an engine 31 (see FIG. 2) as a prime mover; and a body cover 18 that is mounted on an upper portion of the machine room 17.

As illustrated in FIG. 2, also, the upperstructure 12 has: a controller 21 that is housed in the machine room 17 to control the all motions of the vehicle body; an input device 22 that is connected in communication with a later-described input/output interface 21D (see FIG. 3) of the controller 21 to enter various items of information to the controller 21; and a hydraulic drive system 23 for moving the front working device 13 through hydraulic pressure. Incidentally, a specific configuration of the hydraulic drive system 23 will be described later.

The front working device 13 shown in FIG. 1 has: a boom 13A that has a proximal end rotatably attached to the upperstructure 12 and rotates in the vertical directions; an arm 13B that is rotatably attached to a distal end of the boom 13A and rotates in the vertical directions; and a bucket 13C that is rotatably attached to a distal end of the arm 13B and rotates in the vertical directions.

Also, the front working device 13 has: a boom cylinder 13*a* that connects the upperstructure 12 and the boom 13A, and extends and contracts in order to rotate the boom 13A; an arm cylinder 13*b* that is placed on the upper side of the boom 13A, and connects the boom 13A and the arm 13B, as well as extends and contracts in order to rotate the arm 13B; and a bucket cylinder 13*c* that connects the arm 13B and the bucket 13C, and extends and contracts in order to rotate the bucket 13C.

As illustrated in FIG. 2, the boom cylinder 13*a* includes: a cylinder tube 13*a*1 to which pressure oil is supplied; a piston 13*a*4 that is housed within the cylinder tube 13*a*1 in a slidable manner, and partitions the interior of the cylinder tube 13*a*1 into a bottom chamber 13*a*2 and a rod chamber 13*a*3; and a piston rod 13*a*5 that is partially housed in the rod chamber 13*a*3 of the cylinder tube 13*a*1, and is coupled at a proximal end to the piston 13*a*4.

In the boom cylinder 13*a* configured as described above, upon pressure oil being supplied to the bottom chamber 13*a*2 of the cylinder tube 13*a*1, the pressure in the bottom chamber 13*a*2 rises to cause the piston 13*a*4 to be pushed toward the rod chamber 13a3. Thereby, the piston rod 13a5 extends toward the outside of the cylinder tube 13a1 to produce the boom raising motion.

Meanwhile, upon pressure oil being supplied to the rod chamber 13a3 of the cylinder tube 13a1, the pressure in the rod chamber 13a3 rises to cause the piston 13a4 to be pushed back toward the bottom chamber 13a2. Thereby, the piston rod 13a5 contracts and retracts into the cylinder tube 13a1 to produce the boom lowering motion. Thus, the jack-up operation to jack up the vehicle body is rendered possible by use of the boom lowering motion of the boom 13A. It is noted that the arm cylinder 13b and the bucket cylinder 13c are similar in configuration to the boom cylinder 13a, and therefore a repetitive description is omitted.

The pair of travel motors 11B, swing motor, boom cylinder 13a, arm cylinder 13b and bucket cylinder 13c, which are described above, constitute hydraulic actuators. It is noted that there are various types of attachments such as the bucket 13C for the hydraulic excavator 100, and the bucket 13C may be changed to a breaker (not shown) excavating base rock, a secondary crusher (not shown) crushing rocks, or the like, in which using an attachment fitting the details of work enables various kinds of work including excavation and crushing.

In the cab 15 shown in FIG. 1, an operating lever 15A (see FIG. 2) serving as an operating device is placed close to the right side of the operator to allow the operator to grasp the operating lever 15A with his/her right hand for operation of the boom cylinder 13a and the bucket cylinder 13c. Another operating lever (not shown) is placed close to the left side of the operator for operation of the arm cylinder 13b and the swing motor. And, a travel pedal (not shown) is placed below in front of the operator for operation of the pair of travel motors 11B. Each of the above devices is electrically connected to the controller 21.

Motion directions and motion speeds of the boom cylinder 13a, arm cylinder 13b, bucket cylinder 13c, pair of travel motors 11B and swing motor are preset by use of operating directions and manipulated variables of the operating lever 15A on the right side of the operator, the operating lever on the left side of the operator, and the travel pedal.

The operating lever 15A on the right side of the operator is configured to rotate the boom 13A in the vertical directions in response to the manipulated variable produced when the operating lever 15A is operated in the front-rear directions. Also, the operating lever 15A is configured to rotate the bucket 13C in the vertical directions in response to the manipulated variable produced when the operating lever 15A is operated in the left-right directions. The operating lever on the left side of the operator is configured to swing the upperstructure 12 in the lateral direction in response to the manipulated variable produced when it is operated in the front-rear directions. Also, the operating lever is configured to rotate the arm 13B in the vertical directions in response to the manipulated variable produced when it is operated in the left-right directions.

Figure 3:
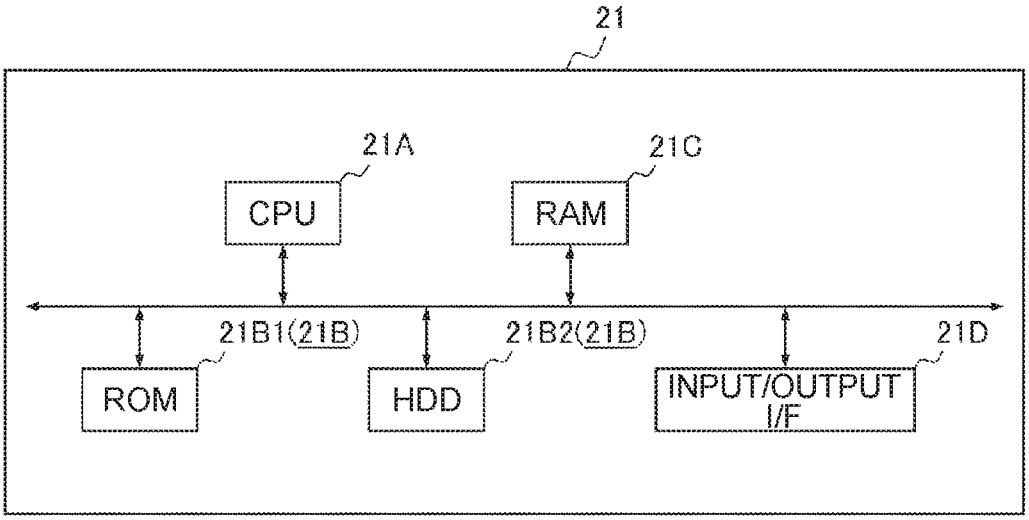
FIG. 3 is a schematic block diagram illustrating the hardware configuration of a controller shown in FIG. 2.

FIG. 3 is a schematic block diagram illustrating the hardware configuration of the controller 21.

As illustrated in FIG. 3, the controller 21 is composed of hardware including, for example: a CPU (Central Processing Unit) 21A that performs various kinds of calculations for control on all motions of the vehicle body; a storage device 21B that includes ROM (Read Only Memory) 21B1, HDD (Hard Disk Drive) 21B2, and the like and stores programs to execute calculations by the CPU 21A; RAM (Random Access Memory) 21C serving as a working area for the CPU 21A to execute the program; and an input/output interface 21D for input/output of various items of information and signals to/from an external device, which are not shown.

In such a hardware configuration, the RAM 21C reads a program stored in the ROM 21B1, the HDD 21B2 or on a not-shown storage medium such as an optical disc or the like, and motions are carried out under the control of the CPU 21A, so that the program (software) and the hardware cooperate with each other to form a functional block in which the functionality of the controller 21 is implemented. Incidentally, details of the functional configuration of the controller 21 which is a feature of the embodiment will be described later.

The input device 22 shown in FIG. 2 is carried by, e.g., the operator, and is composed of a portable terminal, such as a touch panel or the like, that displays various items of information on a screen and accepts input from the operator. The operator in the cab 15 enters specifications of the hydraulic excavator 100 including the vehicle-body weight, on the screen of the input device 22, and then the information is transmitted to the controller 21. Accordingly, the input device 22 functions as a body weight acquisition device which acquires the weight of the vehicle body. It is noted that, in the embodiment, the sum total of the weights of the undercarriage 11 and the upperstructure 12, exclusive of the front working device 13, is used as the vehicle-body weight, but the present invention is not limited to this case, the sum total of the weights of the undercarriage 11, upperstructure 12 and front working device 13 may be used.

The hydraulic drive system 23 produces pressure oil as a function of the operation of the operating lever 15A on the right side of the operator in the cab 15, the operating lever on the left side of the operator and the travel pedal in order to drive the boom cylinder 13a, arm cylinder 13b, bucket cylinder 13c, pair of travel motors 11B and swing motor.

The configuration of the hydraulic drive system 23 to drive the hydraulic actuators will now be described in detail with reference to FIG. 2. It is noted that the figure illustrates the configuration relating to the boom cylinder 13a out of hydraulic actuators, and because the configurations of the remainder, arm cylinder 13b, bucket cylinder 13c, pair of travel motors 11B and swing motor are not in the characterizing part of the present invention, the illustration and description of the configurations are omitted.

As illustrated in FIG. 2, the hydraulic drive system 23 includes: the engine 31 as a prime mover; a hydraulic oil tank 32 for storage of hydraulic oil; a hydraulic pump 33 which is connected to an output shaft of the engine 31 and delivers the hydraulic oil in the hydraulic oil tank 32 as pressure oil; and a pilot pump 34 which delivers pilot pressure oil.

The hydraulic drive system 23 also includes a proportional solenoid valve 35 as a regulator to adjust the volume of the hydraulic pump 33, and an open-center type directional control valve 36. The proportional solenoid valve 35 is connected in communication with the controller 21. The directional control valve 36 is connected via pilot ducts 51A, 51B to pressure receivers 36A, 36B which are formed on the right and left sides to control the flow of pressure oil supplied from the hydraulic pump 33 to the boom cylinder 13a.

The hydraulic drive system 23 also includes a pressure sensor 37 and pilot pressure sensors 38A, 38B. The pressure sensor 37 is installed on a duct 52 which connects the directional control valve 36 and the bottom chamber 13a2 of the boom cylinder 13a, in order to detect a pressure of the hydraulic oil flowing in the duct 52, that is, a pressure on the bottom side of the boom cylinder 13a (hereinafter descriptively referred to as a "bottom pressure"). The pilot pressure sensors 38A, 38B are installed respectively on pilot ducts 51A, 51B which respectively connect the operating lever 15A and the left and right pressure receivers 36A, 36B of the directional control valve 36, and therefore the pilot pressure sensors 38A, 38B detect pressures of the hydraulic oil flowing in the respective pilot ducts 51A, 51B, that is, pilot pressures.

Further, the hydraulic drive system 23 includes a delivery pressure sensor 39 as a delivery pressure detector to detect a delivery pressure of the hydraulic pump 33. The delivery pressure sensor 39 is placed midway through a center bypass duct 53 which connects the hydraulic pump 33 to the hydraulic oil tank 32, and the delivery pressure sensor 39 is located upstream of the directional control valve 36, that is, closer to the delivery outlet of the hydraulic pump 33.

The pressure sensor 37, pilot pressure sensors 38A, 38B and delivery pressure sensor 39, which are described above, are connected in communication with the controller 21, so that the information obtained from the respective sensors 37, 38A, 38B, 39 is input to the controller 21. And, the controller 21 converts the pilot pressures detected by the pilot pressure sensors 38A, 38B into a manipulated variable of the operating lever 15A to perform various kinds of computations. In other words, the pilot pressure sensors 38A, 38B function as a manipulated variable detector to detect the manipulated variable of the operating lever 15A.

The hydraulic drive system 23 further includes a center bypass selector valve 40 and a proportional solenoid valve 41 as a center-bypass-selector-valve operating valve for switching operation of the center bypass selector valve 40. The center bypass selector valve 40 is placed midway through the center bypass duct 53 and downstream of the directional control valve 36, and has valve-opening area characteristics capable of fully closing the center bypass duct 53.

The hydraulic pump 33 consists of a variable displacement type hydraulic pump which delivers pressure oil at a flow rate corresponding with a tilt angle changed by the proportional solenoid valve 35. Specifically, the hydraulic pump 33 has, as a variable displacement mechanism, for example, a swash plate (not shown), and adjusts the inclination angle of the swash plate in order to control the delivery flow rate of pressure oil. In the following, the hydraulic pump 33 will be described as a swash plate pump. However, the hydraulic pump 33 may be an oblique shaft pump or the like as long as it has a function of controlling the delivery flow rate of pressure oil.

The proportional solenoid valve 35 adjusts the volume (displacement) of the hydraulic pump 33 on the basis of a drive signal output from the controller 21. Specifically, upon reception of a drive signal from the controller 21, the proportional solenoid valve 35 produces a control pressure corresponding to the drive signal, from the pilot pressure oil which is delivered by the pilot pump 34, and the inclination angle of the swash plate of the hydraulic pump 33 is changed based on the control pressure. As a result, the volume of the hydraulic pump 33 is able to be adjusted to control the absorption torque of the hydraulic pump 33.

The directional control valve 36 is connected between the boom cylinder 13*a* and the hydraulic pump 33. Although not shown, the directional control valve 36 has a spool stroked within a housing forming an outer shell, in order to adjust the direction and the flow rate of pressure oil discharged from the hydraulic pump 33. Also, the directional control valve 36 has: a switch position L in which the hydraulic oil is directed toward the bottom chamber 13*a*2 of the boom cylinder 13*a* in order to cause the boom cylinder 13*a* to extend; a switch position N in which the hydraulic oil is flown into the hydraulic oil tank 32 without being directed toward the boom cylinder 13*a*; and a switch position R in which the hydraulic oil is directed toward the rod chamber 13*a*3 of the boom cylinder 13*a* in order to cause the boom cylinder 13*a* to contract.

In the switch position R of the directional control valve 36, a throttle 36*a* is incorporated for mitigation of vibrations produced during the boom lowering motion. And, the directional control valve 36 is configured to be switched to any of the three switch positions L, N, R while changing the stroke distance of the spool as a function of the pressure of the pilot pressure oil flowing into each of the left and right pressure receivers 36A, 36B though the respective pilot ducts 51A, 51B from the pilot pump 34.

In such a configuration of the hydraulic drive system 23, the hydraulic pump 33 is driven by a drive force of the engine 31, so that the pressure oil delivered by the hydraulic pump 33 is supplied to the directional control valve 36, and the pilot pressure oil delivered by the pilot pump 34 is supplied to the operating lever 15A. At this time, when the operator in the cab 15 operates the operating lever 15A in the front-rear direction, the operating device 1A reduces the pressure of the pilot pressure oil as a function of the manipulated variable and then supplies the pilot pressure oil to each of the left and right pressure receivers 36A, 36B of the directional control valve 36 through the pilot ducts 51A, 51B.

Thus, the spool in the directional control valve 36 is switched in position by the pilot pressure oil, so that the pressure oil flowing from the hydraulic pump 33 into the directional control valve 36 is supplied to the boom cylinder 13*a*, thereby allowing the boom 13A to be driven through the extension and contraction of the boom cylinder 13*a*, respectively. In short, the boom raising motion or the boom lowering motion can be performed according to the operation of the operating lever 15A effected by the operator.

Figure 4:
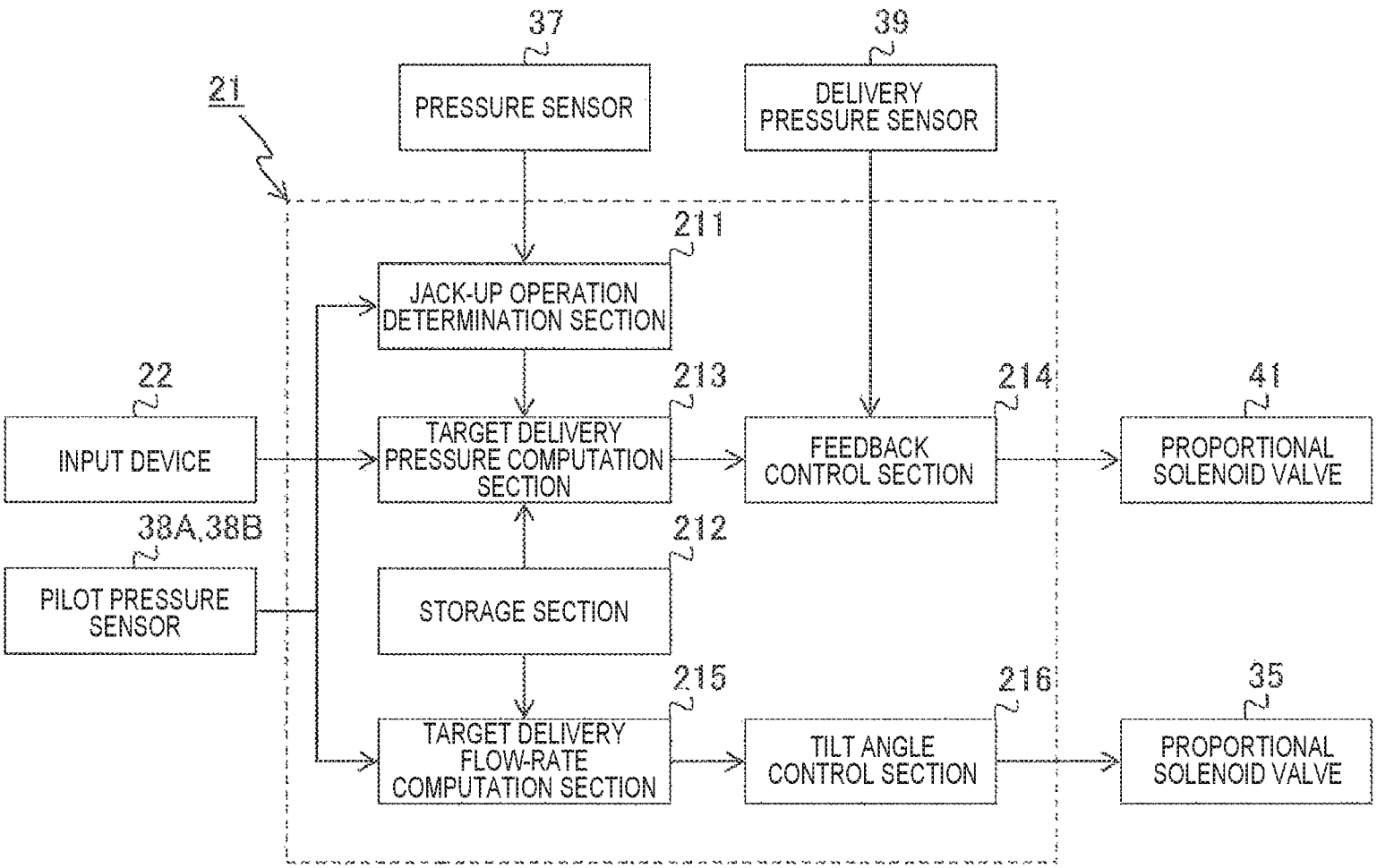
FIG. 4 is a block diagram illustrating the functional configuration of the controller shown in FIG. 2.

A concrete functional configuration of the controller 21 which is a feature of the embodiment will now be described in detail with reference to FIG. 4. FIG. 4 is a block diagram illustrating the functional configuration of the controller 21.

The controller 21 is configured to include a jack-up operation determination section 211, storage section 212, target delivery pressure computation section 213, feedback control section 214, target delivery flow-rate computation section 215 and tilt angle control section 216.

The jack-up operation determination section 211 determines whether or not the jack-up operation is performed, based on the manipulated variable of the operating lever 15A corresponding to the pilot pressures detected by the pilot pressure sensors 38A, 38B, and based on the bottom pressure of the boom cylinder 13*a* detected by the pressure sensor 37.

The storage section 212 stores a first relationship and a section relationship. The first relationship is between the target delivery pressures of the hydraulic pump 33 (aim pump delivery pressure) and the manipulated variables of the operating lever 15A for the boom lowering motion preset for each vehicle-body weight. The second relationship is between the target delivery flow rates of the hydraulic pump 33 (aim pump flow rate) and the manipulated variables of the operating lever 15A for the boom lowering motion preset for each vehicle-body weight.

Figure 5:
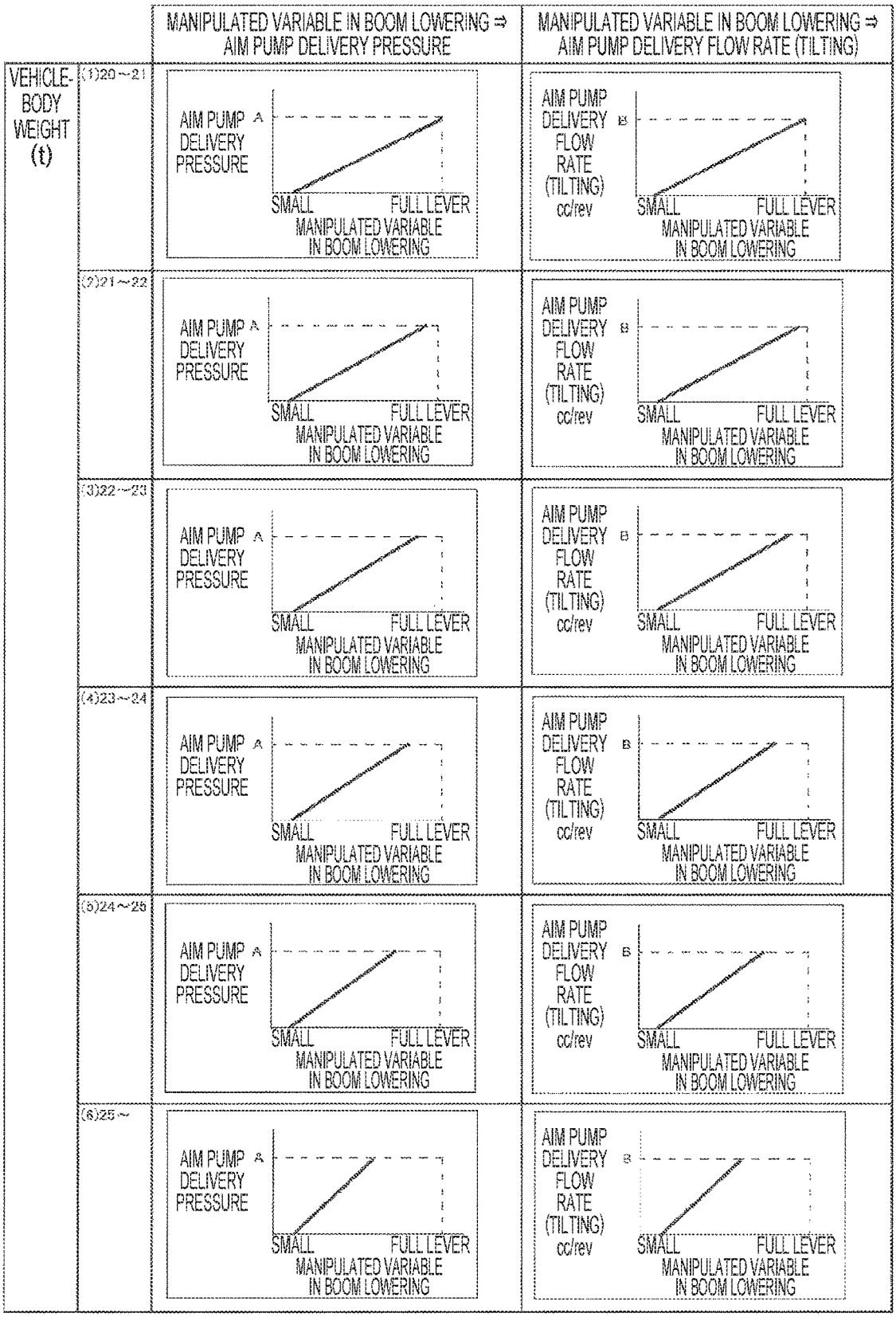
FIG. 5 is a diagram illustrating concrete examples of a first relationship and a second relationship stored in a storage section illustrated in FIG. 4.

FIG. 5 is a diagram illustrating a concrete example of the first relationship and second relationship stored in the storage section 212.

As illustrated in FIG. 5, the first relationship stored in the storage section 212 is, for example, a proportional relationship in which the target delivery pressure increases as the manipulate variable for the boom lowering motion becomes greater on a vehicle-body weights basis such as (1) 20 t to 21 t, (2), 21 t to 22 t, (3) 22 t to 23 t, (4) 23 t to 24 t, (5) 24 t to 25 t, and (6) 25 t~. Further, with increase in vehicle-body weight, that is, in the order from (1) to (6), the slope of the proportional relationship is set to be greater.

Also, the second relationship stored in the storage section 212 is, for example, a proportional relationship in which the target delivery flow rate increases as the manipulate variable for the boom lowering motion becomes greater on a vehicle-body weights basis such as (1) 20 t to 21 t, (2), 21 t to 22 t, (3) 22 t to 23 t, (4) 23 t to 24 t, (5) 24 t to 25 t, and (6) 25 t~. Further, with increase in vehicle-body weight, that is, in the order from (1) to (6), the slope of the proportional relationship is set to be greater.

Target delivery pressure computation section 213 applies the vehicle-body weight inputted through the input device 22, and the manipulated variable of the operating lever 15A corresponding to the pilot pressures detected by the pilot pressure sensors 38A, 38B, to the first relationship stored in the storage section 212, in order to calculate a target delivery pressure of the hydraulic pump 33. The feedback control section 214 performs feedback control on the center bypass selector valve 40 through the proportional solenoid valve 41 such that the delivery pressure of the hydraulic pump 33 detected by the delivery pressure sensor 39 agrees with the target delivery pressure of the hydraulic pump 33 calculated by the target delivery pressure computation section 213.

The target delivery flow-rate computation section 215 applies the vehicle-body weight inputted through the input device 22, and the manipulated variable of the operating lever 15A corresponding to the pilot pressures detected by the pilot pressure sensors 38A, 38B, to the second relationship stored in the storage section 212, in order to calculate a target delivery flow rate of the hydraulic pump 33. The tilt angle control section 216 outputs a drive signal corresponding to the target delivery flow rate of the hydraulic pump 33 calculated by the target delivery flow-rate computation section 215, to the proportional solenoid valve 35 in order to control the tilt angle of the hydraulic pump 33.

Figure 6:
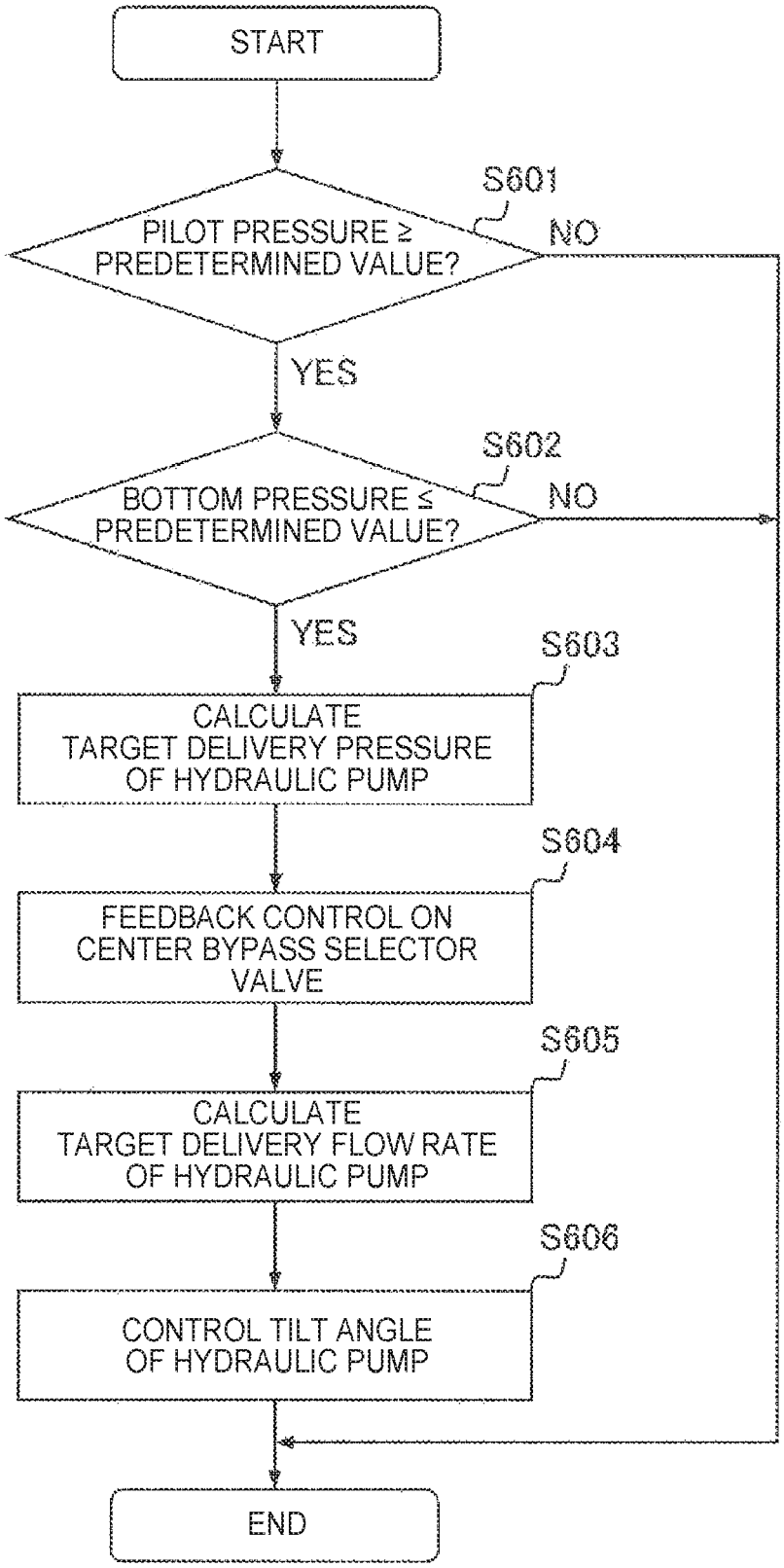
FIG. 6 is a flowchart illustrating the flow of control process of a controller on a hydraulic drive system for the jack-up operation according to the embodiment.

The control process of the controller 21 on the hydraulic drive system 23 for the jack-up operation according to the embodiment will now be described in detail with reference to the flowchart illustrated in FIG. 6. FIG. 6 is a flowchart illustrating the flow of the control process of the controller 21 on the hydraulic drive system 23 according to the embodiment.

As illustrated in FIG. 6, first, the jack-up operation determination section 211 of the controller 21 obtains detection signals of the pilot pressure sensors 38A, 38B, and then determines whether or not the pilot pressure detected by the pilot pressure sensor 38B is equal to or greater than a predetermined value (e.g., 5 MPa) (step (hereinafter abbreviated as "S") 601).

At this stage, if the jack-up operation determination section 211 confirms that the pilot pressure detected by the pilot pressure sensor 38B is less than the predetermined value (S601/NO), the jack-up operation determination section 211 determines that jack-up operation is not performed because the boom lowering motion is not performed. Then, the control process of the controller 21 on the hydraulic drive system 23 for the jack-up operation according to the embodiment is terminated.

Meanwhile, if the jack-up operation determination section 211 confirms that the pilot pressure detected by the pilot pressure sensor 38B is equal to or greater than the predetermined value (S601/YES), because the boom lowering motion is performed, the jack-up operation determination section 211 obtains a detection signal of the pressure sensor 37, and then determines whether or not the bottom pressure of the boom cylinder 13*a* detected by the pressure sensor 37 is equal to or less than a predetermined value (e.g., 10 MPa) (S602).

At this stage, if the jack-up operation determination section 211 confirms that the bottom pressure of the boom cylinder 13*a* detected by the pressure sensor 37 exceeds the predetermined value (S602/NO), the jack-up operation determination section 211 determines that jack-up operation is not performed. Then, the control process of the controller 21 on the hydraulic drive system 23 for the jack-up operation according to the embodiment is terminated.

Meanwhile, in S602, if the jack-up operation determination section 211 confirms that the bottom pressure of the boom cylinder 13*a* detected by the pressure sensor 37 is equal to or less than the predetermined value (S602/YES), the jack-up operation determination section 211 determines that jack-up operation is performed, and then transmits the determination result to the target delivery pressure computation section 213 of the controller 21.

Subsequently, upon reception of the determination result from the jack-up operation determination section 211, the target delivery pressure computation section 213 obtains input information of the input device 22 and the detection signals of the pilot pressure sensors 38A, 38B, and also references information in the storage section 212 to calculate a target delivery pressure of the hydraulic pump 33 from: the vehicle-body weight inputted through the input device 22; the manipulation variable of the operating lever 15A corresponding to the pilot pressures detected by the pilot pressure sensors 38A, 38B; and the first relationship stored in the storage section 212 (S603). Then, the target delivery pressure computation section 213 transmits the computation result to the feedback control section 214 of the controller 21.

Subsequently, upon reception of the computation result from the target delivery pressure computation section 213, the feedback control section 214 calculates a difference between the delivery pressure of the hydraulic pump 33 detected by the delivery pressure sensor 39 and the target delivery pressure of the hydraulic pump 33 calculated by the target delivery pressure computation section 213, and then generates a drive signal from the difference to be transmitted to the proportional solenoid valve 41. Thus, upon reception of the drive signal, the proportional solenoid valve 41 produces a control pressure corresponding to the drive signal, from the pilot pressure oil which is delivered by the pilot pump 34. Then, the proportional solenoid valve 41 provides the control pressure to the center bypass selector valve 40 in order to adjust the opening degree of the center bypass selector valve 40, and thus the feedback control is performed on the center bypass selector valve 40 (S604).

Also, the target delivery flow-rate computation section 215 obtains the input formation of the input device 22 and the detection signals of the pilot pressure sensors 38A, 38B, and references the information in the storage section 212 to calculate a target delivery flow rate of the hydraulic pump 33 from: the vehicle-body weight inputted through the input device 22; the manipulated variable of the operating lever 15A corresponding to the pilot pressures detected by the pilot pressure sensors 38A, 38B; and the second relationship stored in the storage section 212 (S605). Then, the target delivery flow-rate computation section 215 transmits the computation result to the tilt angle control section 216 of the controller 21.

Subsequently, upon reception of the computation result from the target delivery flow-rate computation section 215, the tilt angle control section 216 transmits, to the proportional solenoid valve 35, a drive signal corresponding to the target delivery flow rate of the hydraulic pump 33 calculated by the target delivery flow-rate computation section 215. Thus, upon reception of the drive signal, the proportional solenoid valve 35 produces a control pressure corresponding to the drive signal, from the pilot pressure oil which is delivered by the pilot pump 34. Then, the proportional solenoid valve 35 provides the control pressure to a tilting actuator (not shown) of the hydraulic pump 33 in order to adjust the inclination angle of a swash plate of the hydraulic pump 33, so that the tilt angle of the hydraulic pump 33 is controlled (S606). In this manner, the control process of the controller 21 on the hydraulic drive system 23 for the jack-up operation according to the embodiment is terminated.

With the hydraulic excavator 100 according to the embodiment configured as described above, the controller 21 controls the motion of the center bypass selector valve 40 on the basis of the vehicle-body weight inputted through the input device 22, the manipulated variable of the operating lever 15A corresponding to the pilot pressures detected by the pilot pressure sensors 38A, 38B, and the delivery pressure of the hydraulic pump 33 detected by the delivery pressure sensor 39. Because of this, even if the operating lever 15A is minutely operated during the boom lowering motion, the flow rate of the hydraulic pump 33 can be properly controlled without a sudden rise in delivery pressure of the hydraulic pump 33. Therefore, it is possible to enhance the operability for the jack-up operation, and also, to reduce the speed variations of the hydraulic actuators in the combined operation of a plurality of hydraulic actuators, and the like.

Further, the vehicle-body weight included in the specifications of the hydraulic excavator 100 is reflected in the feedback control which is performed on the center bypass selector valve 40 by the feedback control section 214 of the controller 21. Therefore, even if the delivery pressure of the hydraulic pump 33 required for lifting the vehicle body up varies according to the weight of the vehicle body in the jack up operation, it is possible to maintain the amount of lifting the vehicle body (the amount of upward movement of the vehicle body) with respect to the manipulated variable of the operating lever 15A. In this manner, the embodiment achieves satisfactory operational performance in the jack-up operation irrespective of the weight of the vehicle body.

Further, in the hydraulic excavator 100 according to the embodiment, the feedback control section 214 is configured to perform the feedback control on the center bypass selector valve 40 only when the jack-up operation determination section 211 determines that the jack-up operation is performed. Because of this, the center bypass selector valve 40 is not actuated during the boom lowering motion and the boom raising motion other than the jack-up operation. As a result, because a malfunction of the boom cylinder 13*a* can be prevented, the boom 13A is able to be stably rotated in the vertical directions in step with the operation of the operating lever 15A by the operator.

Further, in the hydraulic excavator 100 according to the embodiment, the input device 22 is connected to the input/output interface 21D of the controller 21 and the operator enters the specifications of the hydraulic excavator 100 through the screen of the input device 22 carried by the operator. As a result, the settings suitable for the vehicle-body weight of the hydraulic excavator 100 on which the operator gets can be readily established for the feedback control on the center bypass selector valve 40. This offers improved convenience to the operator when the jack-up operation is performed.

Further, in the hydraulic excavator 100 according to the embodiment, in addition to the feedback control of the feedback control section 214 on the center bypass selector valve 40, the tilt angle control section 216 of the controller 21 controls the tilt angle of the hydraulic pump 33 on the basis of the vehicle-body weight inputted through the input device 22 and the manipulated variable of the operating lever 15A corresponding to the pilot pressures detected by the pilot pressure sensors 38A, 38B. Because of this, the delivery flow rate of the hydraulic pump 33 is adjusted according to the operation of the operating lever 15A by the operator, thereby quickly increasing/decreasing the speed of the boom 13A. This enables the movement of the vehicle body as intended by the operator in the jack-up operation, so that high reliability of the operational performance of the hydraulic excavator 100 can be ensured. Further, in the embodiment, the force required for jacking up, which is different from vehicle rank to vehicle rank, can be adjusted by entering a vehicle-body weight before shipment. Further, in the embodiment, the jacking-up force can be adjusted even when the attachment of the front working device is replaced at the site of work or when the weight of the counterweight is increased to change the vehicle-body weight.

It should be understood that each of the above-described embodiments according to the present invention has been described in details for the purpose of clearly explaining the present invention, and the present invention is not necessarily limited to including all configurations described above. Further, a part of the configuration of an embodiment may be substituted by the configuration of another embodiment. Moreover, the configuration of an embodiment may be added to the configuration of another embodiment.

REFERENCE SIGN LIST

11 . . . Undercarriage
11A . . . Crawler
11B . . . Travel motor
12 . . . Upperstructure
13 . . . Front working device
13A . . . Boom
13*a* . . . Boom cylinder
13*a*1 . . . Cylinder tube
13*a*2 . . . Bottom chamber
13*a*3 . . . Rod chamber
13*a*4 . . . Piston
13*a*5 . . . Piston rod
13B . . . Arm
13*b* . . . Arm cylinder
13C . . . Bucket
13*c* . . . Bucket cylinder
15 . . . Cab
15A . . . Operating lever (operating device)
16 . . . Counterweight
17 . . . Machine room
18 . . . Body cover
21 . . . Controller
22 . . . Input device (body weight acquisition device)

23 . . . Hydraulic drive system
31 . . . Engine
32 . . . Hydraulic oil tank
33 . . . Hydraulic pump
34 . . . Pilot pump
35 . . . Proportional solenoid valve (regulator)
36 . . . Directional control valve
36A, 36B . . . Pressure receiver
36*a* . . . Throttle
37 . . . Pressure sensor
38A, 38B . . . Pilot pressure sensor (manipulated variable detector)
39 . . . Delivery pressure sensor (delivery pressure detector)
40 . . . Center bypass selector valve
41 . . . Proportional solenoid valve (Center-bypass selector valve operating vale)
51A, 51B . . . Pilot duct
52 . . . Duct
53 . . . Center bypass duct
100 . . . Hydraulic excavator (construction machine)
211 . . . Jack-up operation determination section
212 . . . Storage section
213 . . . Target delivery pressure computation section
214 . . . Feedback control section
215 . . . Target delivery flow-rate computation section
216 . . . Tilt angle control section

The invention claimed is:

1. Construction machine comprising: an engine; a hydraulic oil tank that stores hydraulic oil; a hydraulic pump that is driven by the engine and delivers the hydraulic oil in the hydraulic oil tank as pressure oil; a boom cylinder that is operated by the pressure oil delivered by the hydraulic pump; a directional control valve of an open-center type that controls a flow of the pressure oil; an operating device that performs switching operation of the directional control valve; and a boom that rotates in vertical directions through extension and contraction of the boom cylinder, the construction machine performing jack-up operation to lift a vehicle body up by use of a boom lowering motion of the boom, wherein the construction machine includes:

a body weight acquisition device that acquires a weight of the vehicle body;

a manipulated variable detector that detects a manipulated variable of the operating device;

a delivery pressure detector that detects a delivery pressure of the hydraulic pump;

a center bypass selector valve that is installed midway through a center bypass duct and downstream of the directional control valve, the center bypass duct connecting the hydraulic pump to the hydraulic oil tank, the center bypass selector valve having valve-opening area characteristics capable of fully closing the center bypass duct;

a center-bypass-selector-valve operating valve that performs switching operation of the center bypass selector valve; and a controller that controls operation of the center bypass selector valve on the basis of the weight of the vehicle body acquired by the body weight acquisition device, the manipulated variable of the operating device detected by the manipulated variable detector, and the delivery pressure of the hydraulic pump detected by the delivery pressure detector, and wherein the controller includes:

a storage section that stores a first relationship between manipulated variables of the operating device for the boom lowering motion preset for each weight of the vehicle body and target delivery pressures of the hydraulic pump;

a target delivery pressure computation section that applies the weight of the vehicle body acquired by the body weight acquisition device, and the manipulated variable of the operating device detected by the manipulated variable detector, to the first relationship stored in the storage section in order to calculate a target delivery pressure of the hydraulic pump; and a feedback control section that performs feedback control on the center bypass selector valve through the center-bypass-selector-valve operating valve such that the delivery pressure of the hydraulic pump detected by the delivery pressure detector agrees with the target delivery pressure of the hydraulic pump calculated by the target delivery pressure computation section.

2. The construction machine according to claim 1, wherein the controller includes a jack-up operation determination section that determines, based on the manipulated variable of the operating device detected by the manipulated variable detector, whether or not the jack-up operation is operated, and when the jack-up operation determination section determines that the jack-up operation is performed, the feedback control section performs feedback control on the center bypass selector valve.

3. The construction machine according to claim 1, wherein the body weight acquisition device is composed of an input device through which the weight of the vehicle body is inputted to the controller.

4. The construction machine according to claim 1, further comprising a regulator that changes a tilt angle of the hydraulic pump in accordance with a drive signal from the controller, wherein the hydraulic pump is composed of a variable displacement type hydraulic pump that delivers pressure oil at a flow rate corresponding with the tilt angle changed by the regulator, the storage section stores a second relationship between manipulated variables of the operating device for the boom lowering motion preset for each weight of the vehicle body and target delivery flow rates of the hydraulic pump, and the controller includes:

a target delivery flow-rate computation section that applies the weight of the vehicle body acquired by the body weight acquisition device, and the manipulated variable of the operating device detected by the manipulated variable detector, to the second relationship stored in the storage section in order to calculate a target delivery flow rate of the hydraulic pump; and a tilt angle control section that outputs the drive signal corresponding to the target delivery flow rate of the hydraulic pump calculated by the target delivery flow-rate computation section, to the regulator in order to control the tilt angle of the hydraulic pump.

* * * * *